US005732507A

United States Patent [19]

Edwards

[11] Patent Number: 5,732,507

[45] Date of Patent: Mar. 31, 1998

[54] LOUVRE ASSEMBLY

[75] Inventor: Gregory Edwards, New South Wales, Australia

[73] Assignee: H.V. Aluminium Pty. Limited, New South Wales, Australia

[21] Appl. No.: 799,800

[22] Filed: Feb. 13, 1997

Related U.S. Application Data

[63] Continuation of Ser. No. 510,515, filed as PCT/AU94/00629, Oct. 17, 1994 published as WO95/12738, May 11, 1995, abandoned.

[30] Foreign Application Priority Data

| | | | |
|---|---|---|---|
| Nov. 4, 1993 | [AU] | Australia | PM2217 |
| May 17, 1994 | [AU] | Australia | PM5696 |

[51] Int. Cl.[6] ..... E06B 7/086

[52] U.S. Cl. ..... 49/74.1; 49/82.1

[58] Field of Search ..... 49/74.1, 82.1, 49/91.1, 92.1; 160/236, 201, 275, 276, 172 R, 232, 133

[56] References Cited

U.S. PATENT DOCUMENTS

| | | | |
|---|---|---|---|
| Re. 15,904 | 8/1924 | Hein | 160/275 |
| 3,176,757 | 4/1965 | Lomaz | 160/201 |
| 3,853,169 | 12/1974 | Music et al. | 160/172 R |
| 4,016,920 | 4/1977 | Shepard | 160/201 |
| 4,099,346 | 7/1978 | Isono | 160/236 |
| 4,382,460 | 5/1983 | Ben-tal | 160/236 |
| 4,527,355 | 7/1985 | Numakami et al. | |
| 4,763,713 | 8/1988 | Kraus | 160/172 R |
| 4,967,509 | 11/1990 | Storey et al. | 49/74.1 |
| 5,141,042 | 8/1992 | Schwaegerle | 160/236 |
| 5,168,915 | 12/1992 | Lafleur | 160/236 |

FOREIGN PATENT DOCUMENTS

| | | | |
|---|---|---|---|
| 62702/60 | 1/1961 | Australia . | |
| 67080/65 | 5/1967 | Australia . | |
| 50979/79 | 3/1980 | Australia . | |
| 76413/91 | 2/1992 | Australia . | |
| 0244191 | 11/1987 | European Pat. Off. . | |
| 593201 A1 | 4/1994 | European Pat. Off. | 49/74.1 |
| 114351 | 8/1951 | New Zealand . | |
| 131515 | 4/1964 | New Zealand . | |
| 137070 | 10/1965 | New Zealand . | |
| 161656 | 12/1971 | New Zealand . | |
| 2250582 | 10/1992 | United Kingdom | 160/201 |

OTHER PUBLICATIONS

"Standard Extruded Aluminium Shapes Catalogue" Alcan New Zealand Limited, p. 64, Jan. 1992.

*Primary Examiner*—Harry C. Kim
*Assistant Examiner*—Curtis Cohen
*Attorney, Agent, or Firm*—Ladas & Parry

[57] ABSTRACT

A louvre for a louvre assembly comprises a profile having a plurality of optionally useable pivot mounting positions each of which is selectively adapted to be utilized to mount the louvre in an assembly of adjacent louvres. Anyone of the remaining pivot mounting positions is selectively adapted to be utilized to control the pivotable orientation of the louvre in the assembly. Each louvre comprises an up-turned lip at one edge thereof and an down-turned lip at the other edge thereof. These lips serve to prevent ingress of water to the area below the assembly which forms an openable roof structure. An alternative louvre comprises a pair of like formed, elongate, resilient surface profile sections, each having disposed at opposed lateral edges thereof mutual interengagement means, which upon flexure of the respective sections during assembly results in interengagement of the sections. A prefabricated core having tapered or otherwise lateral edges is located between the surface profile sections.

15 Claims, 8 Drawing Sheets

LOUVRE ASSEMBLY

This application is a continuation of application Ser. No. 08/510,515 filed on Aug. 2, 1995 now abandoned and a continuation of International application PCT/AU94/00629 filed on Oct. 17, 1994 and which designated the U.S.

FIELD OF THE INVENTION

The following invention relates to a louvre assembly and more particularly to louvres to be used in a louvre assembly. Moreover, the invention relates to an extruded louvre provided with multiple pivot mounting positions to provide a variety of assembly options and opening/closing control options. Furthermore, a transverse cross-sectional profile of a louvre is disclosed, providing improved waterproof characteristics when adjacent louvres are closed.

PRIOR ART

It is known to provide for example pressed steel louvres having an internally located central pivot axis by which adjacent louvres may pivot to an open or closed orientation for example over a pergola, balcony or the like. Such louvres are limited in their application to a specific pivot arrangement and are not particularly adaptable to other arrangements to suit particular applications. Furthermore, where it might be desirable to allow a high degree of sun through a louvre assembly for example during winter months, it is not known to provide a louvre assembly which is retractable or otherwise readily removable.

OBJECT OF THE INVENTION

It is the object of the present invention to overcome or substantially ameliorate at least one of the abovementioned disadvantages and/or more generally to provide an improved louvre assembly.

DISCLOSURE OF THE INVENTION

There is disclosed herein a louvre for a louvre assembly, comprising:

a profile having a plurality of optionally useable pivot mounting positions, each of which is selectively adapted to be utilised to mount the louvre in the assembly, and another of which is selectively adapted to be utilised to be controlled to effect the pivotable orientation of the louvre, and an up-turned lip at one edge of the profile and a down-turned lip at the other edge of the profile.

Preferably, each louvre further comprises a groove nearby one of said lips adjacent to receive a sealing strip to seal against a sealing surface upon a like formed adjacent louvre in the assembly when closed.

Preferably, each profile is extruded and comprises an upper surface spaced from a lower surface by an internal ribs.

Preferably, an insulating foam such as polyurethane is injected into the space between the opposed surfaces of the louvre.

There is further disclosed herein a louvre assembly comprising a plurality of louvres as disclosed above and wherein at each end of each louvre there is provided a wheel mounted to rotate at one of said pivot mounting positions, the assembly comprising a transverse track at each end of the respective louvres upon which said respective wheels are adapted to roll, and a locking bar adapted to be moved into a first position wherein the wheels are locked thereby against rolling upon the track, and a second position wherein the wheels are free to roll.

Preferably, the tracks each comprise positioning lugs into which the wheels roll, the positioning lugs being respectively aligned with locking lugs provided in the locking bar.

Preferably, a pin is provided at said another mounting position and is adapted to be controlled by a transversely extending control bar, the control bar in turn being adapted to be controlled by a driving bar.

Preferably, the driving bar extends in an essentially vertical orientation and comprises a pin-in-slot interengagement with the control bar.

Preferably, the louvre assembly is adapted to be mounted between a pair of beams extending transversely with respect to the longitudinal axis of the louvres and wherein each beam comprises at least one gutter upon which water may fall from respective ends of the louvres.

There is further disclosed herein a louvre comprising a pair of like-formed, elongate, resilient surface profile sections, each having disposed at opposed lateral edges thereof mutual interengagement means which upon flexure of the respective sections during assembly results in interengagement of the sections, the louvre further comprising a prefabricated core having tapered or otherwise receded lateral edges providing a gap into which respective end portions of the resilient surface profile sections may enter during assembly and/or disassembly.

Preferably, the blank of foam comprises cut-outs allowing bending of the respective profile sections alongside the lateral edges thereof.

Optionally, a number of tubes may be inserted within the space defined between the surface profile sections, the tubes serving as a means by which the louvre may be pivoted in a louvre assembly.

Preferably, the mutual engagement means comprising at one edge of each respective surface profile section a tongue, and at the other edge an extension having a back-turned lip into which the tongue of the other surface profile section is receivable.

BRIEF DESCRIPTION OF THE DRAWINGS

Preferred forms of the present invention will now be described by way of example with reference to the accompanying drawings, wherein:

FIG. 1(*a*) is a schematic cross-sectional elevational profile of an alternative louvre.

DESCRIPTION OF THE PREFERRED EMBODIMENT

Figure 1:
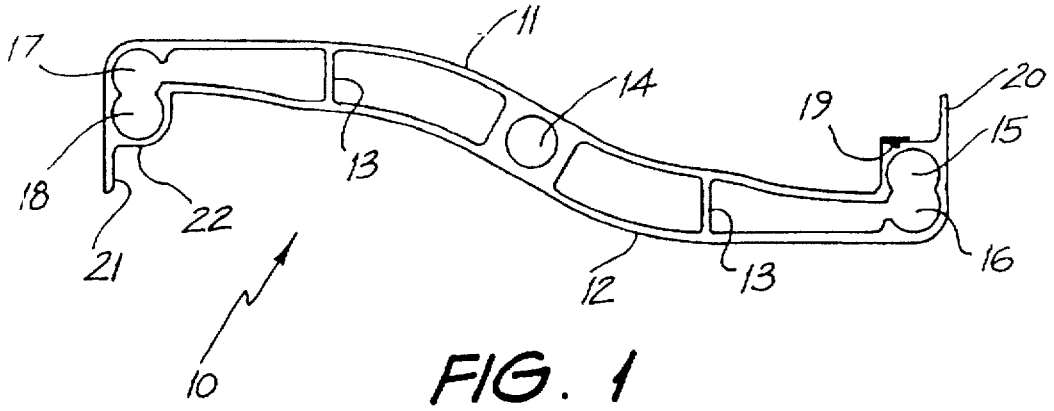
FIG. 1 is a schematic cross-sectional elevational profile of a louvre.
Figure 1A:
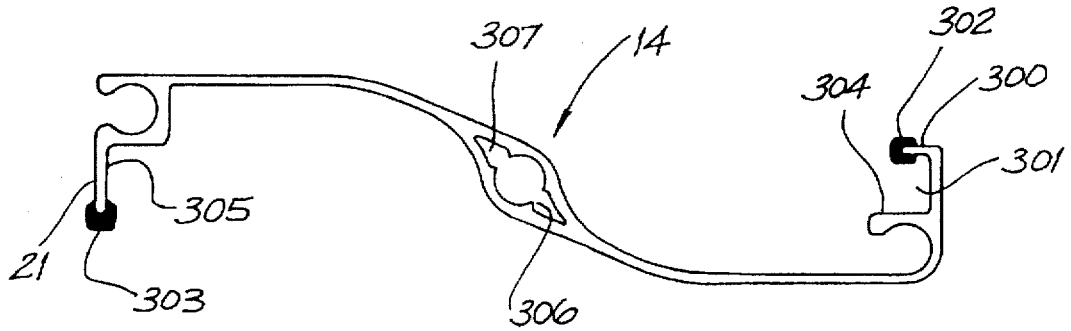

In FIG. 1 of the accompanying drawings there is schematically depicted an extruded louvre 10. Louvre 10 is typically formed of aluminium, however may equally be formed from extruded plastics material, steel or any other material. An extruded metallic louvre 10 might be coated with paint or the like. Louvre 10 comprises an upper surface 11 and a lower surface 12 spaced apart by ribs 13. At each end of the louvre there is provided a pair of edge holes 15, 16 and 17, 18. At the coated with paint or the like. Louvre 10 comprises an upper surface 11 and a lower surface 12 spaced apart by ribs 13. At each end of the louvre there is provided a pair of edge holes 15, 16 and 17, 18. At the centre of the louvre there is provided a central hole 14. The right hand end of louvre 10 comprises an upwardly extending lip 20, whereas the other end of the louvre 10 comprises a downwardly extending lip 21. Nearby the upwardly extending lip there is provided a spline receiver groove 19 which is adapted to receive an extruded plastics or other resilient material sealing strip to seal against a spline sealing surface 22 on an adjacent louvre.

In FIG. 1(*a*), there is depicted an alternative louvre, being some what similar to that depicted in FIG. 1, though comprising a return lip 300 to assist in preventing the ingress of water through the assembly when the louvres are closed. When the louvres are open, an additional cutter 301 is provided to carry water away. Furthermore, as an optional feature a plastic weather strip 302 may be applied to the edge of the lip 300. A similar plastic weather strip 303 might also be applied to the edge of the lip 21 at the opposing part of the louvre. The plastic weather strip 303 should rest against the area marked 304 of an adjacent louvre when closed. Similarly, weather strip 302 would rest against the area marked 305 of an adjacent louvre. The central pivot location 14 of the louvre depicted in FIG. 1(*a*) is surrounded by an I-shaped recess 307 allowing for resilient movement of the upper and lower skin section of the louvre. For indents 306 are provided to secure the assembly to a pivot pin or the like.

Figure 9:
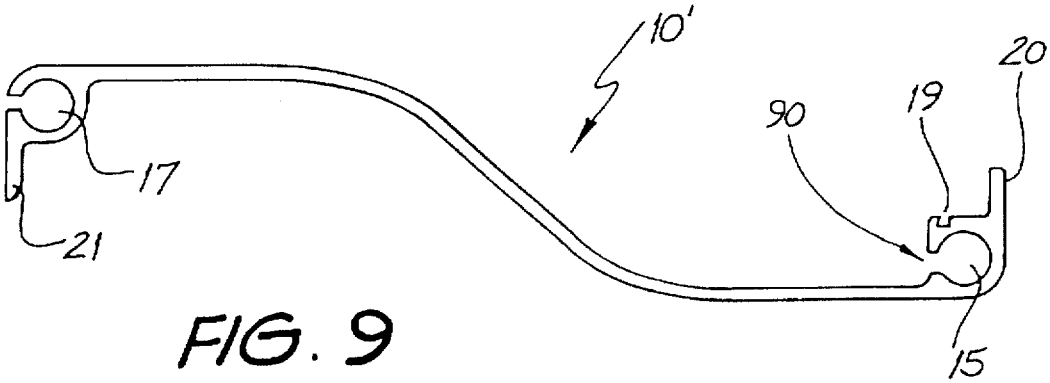
FIG. 9 is a schematic cross-sectional elevational profile of an alternative louvre.
Figure 10:
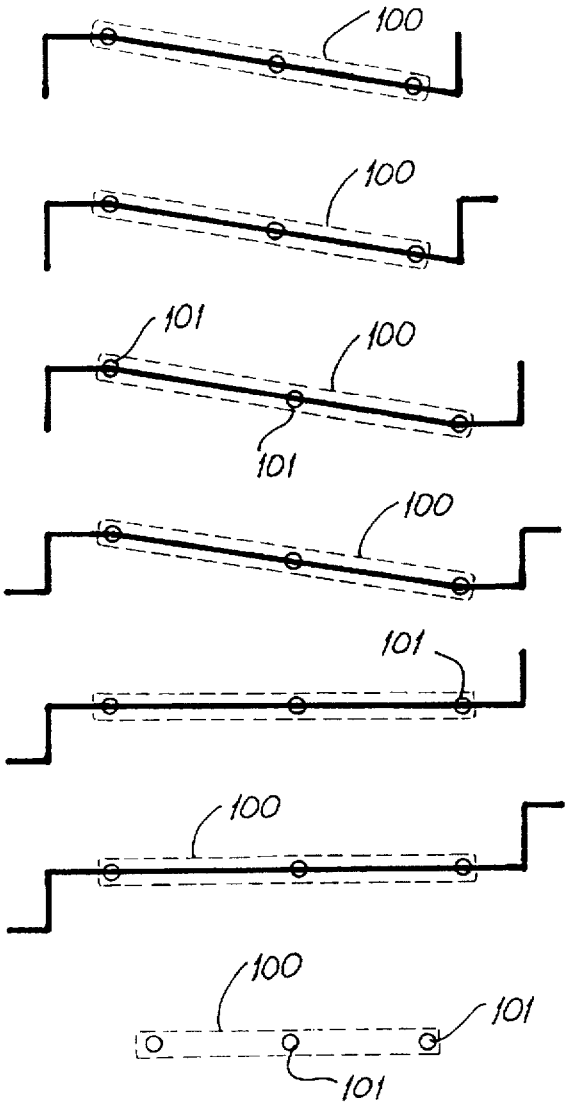
FIG. 10 is a series of schematic end elevational views of a separate end assembly attached to various louvres.
Figure 11:
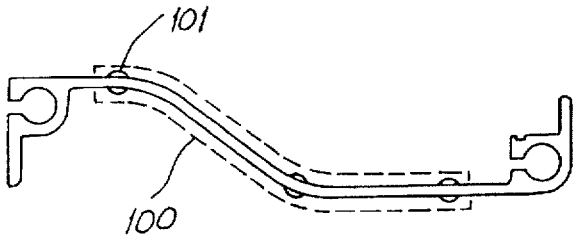
FIG. 11 is a further schematic end elevational view of an end assembly affixed to a louvre.
Figure 12:
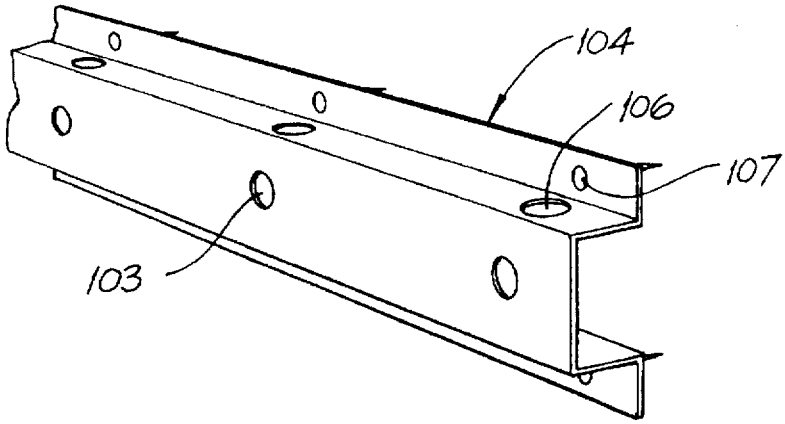
FIG. 12 is a schematic perspective view of a channel to be affixed to a beam.
Figure 13:
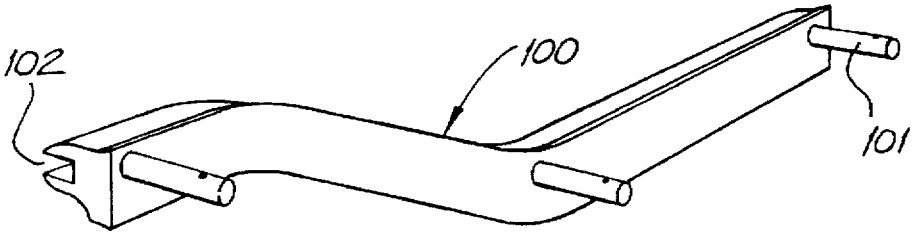
FIG. 13 is a schematic perspective view of an end assembly.
Figure 14:
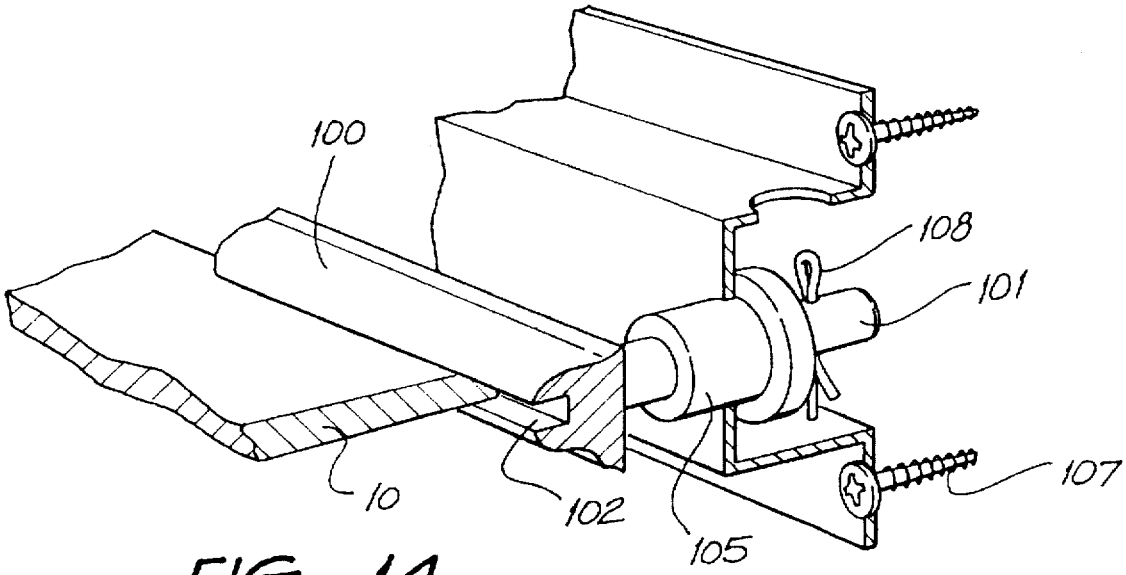
FIG. 14 is a schematic cross-sectional perspective view of an end assembly affixed to the channel of FIG. 12 and a louvre.

An alternative profile as shown in FIG. 9. The profile of FIG. 9, rather than being double layered is a single layer design, however incorporating the lips 20 and 21. At each end of the profile 10' shown in FIG. 9 there is provided a hole 15, 17. The gap 90 shown adjacent hole 15 may be sealed. A spline receiver 19 is incorporated in the profile of FIG. 9.

Figure 2:
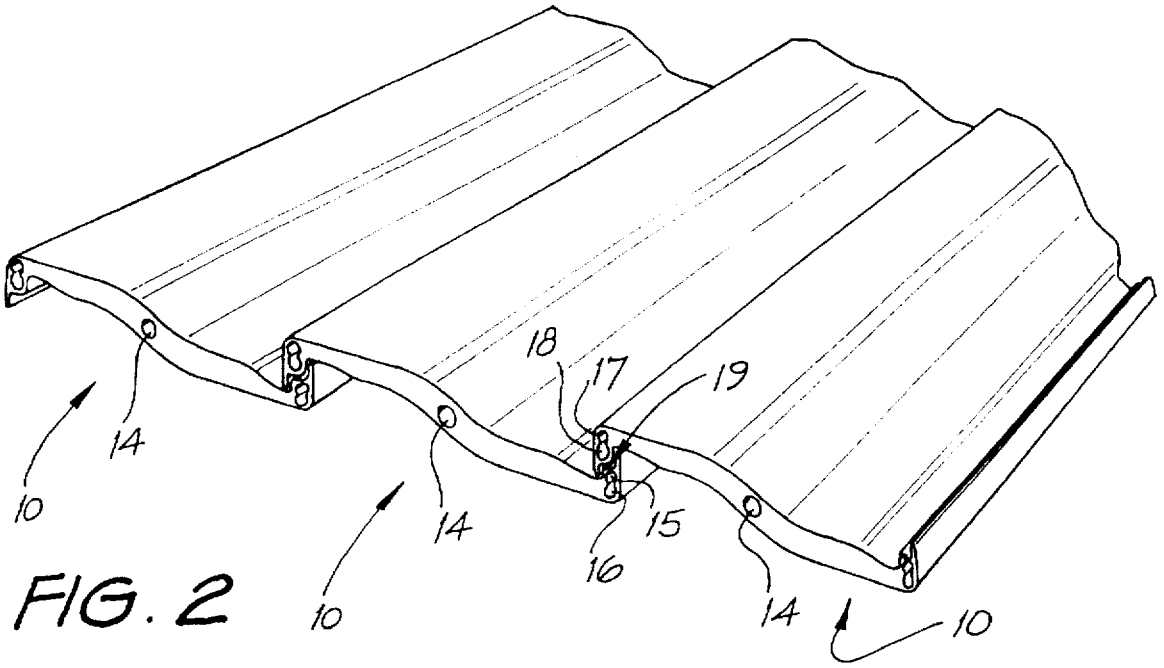
FIG. 2 is a schematic perspective illustration of a plurality of louvres aligned as they would be in an assembly in a closed orientation.

As can be seen in FIG. 2, in a closed position, the lips 20, 21 and the spline in groove 19 cooperate to provide a watertight structure when closed.

As there is a multitude of holes 15, it is possible to pivotally mount each louvre in a variety of configurations. For example with reference to FIG. 2, should be central hole 14 be utilised as a pivot point, each louvre would be allowed to turn in a clockwise direction about the central axis thus opening the louvre assembly.

Should mounting points 15 or 16 be utilised as a pivot point, the left hand end of each louvre (containing pivot point 17 and 18), would be adapted to move upwardly to open the louvre assembly.

Should either holes 17 or 18 be utilised as a pivot mounting point, the right hand end of each louvre (that end containing holes 15 and 16) would be adapted to swing downwardly so as to open the louvre assembly.

Figure 3:
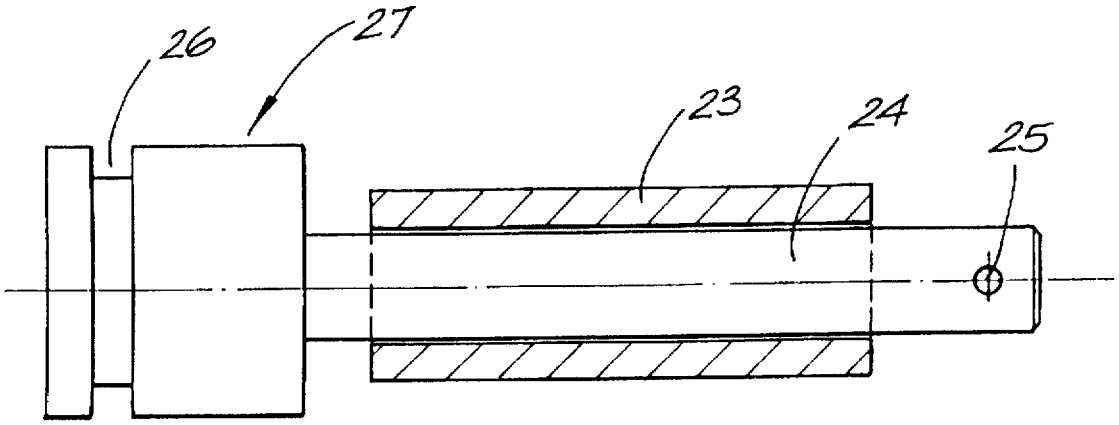
FIG. 3 is a schematic cross-sectional elevational view of a rolling wheel mounted to the louvre of FIG. 1, FIG. 3(*a*) is a schematic cross-sectional elevational view of an alternative rolling wheel mounted to the louvre of FIG. 1 or 1(*a*)
Figure 3A:
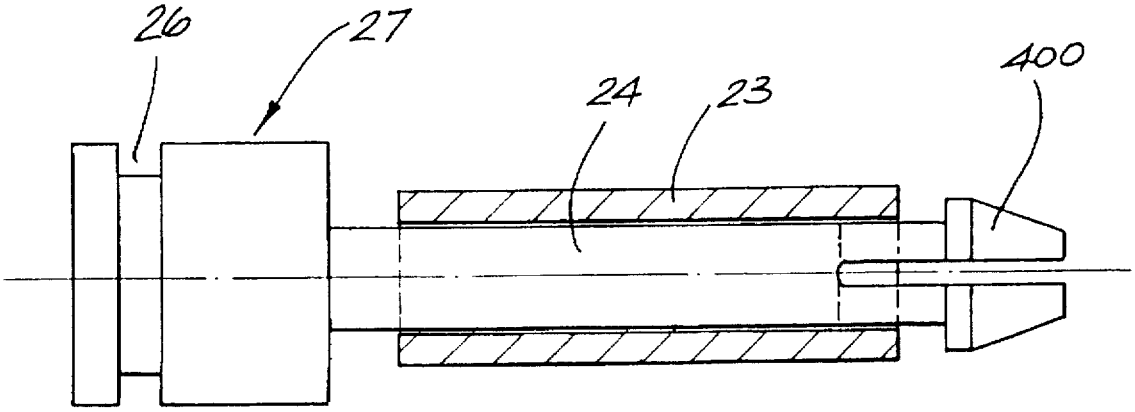
Figure 4:
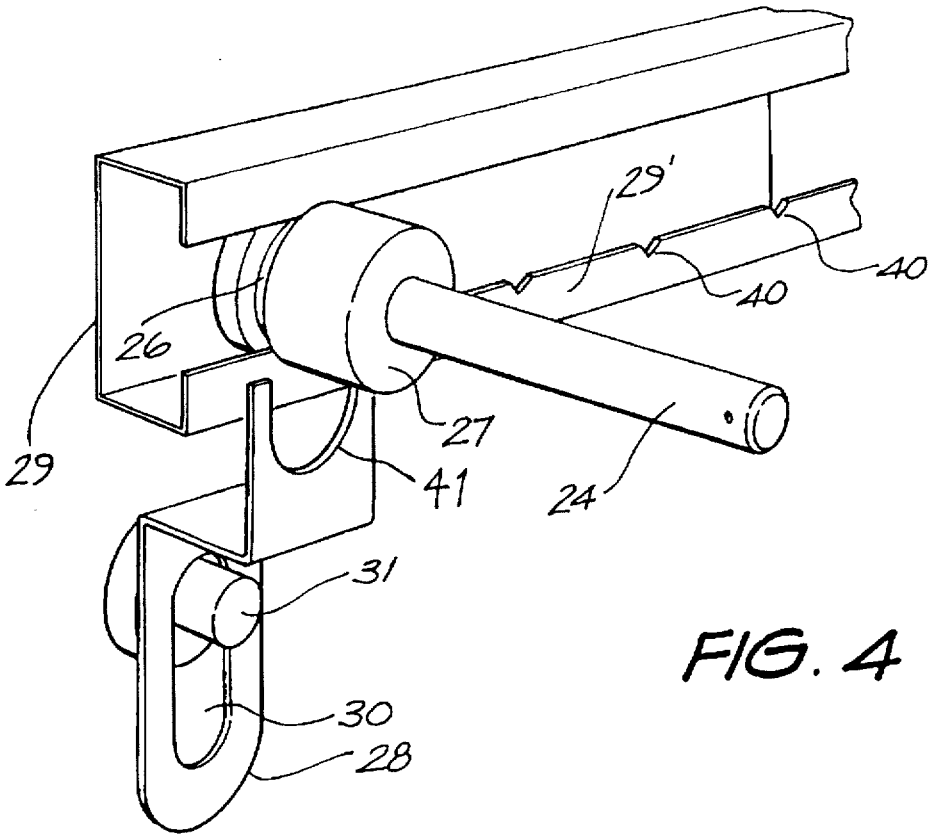
FIG. 4 is a schematic perspective view of the wheel of FIG. 3 mounted upon a track and also showing a locking bar.

With reference to FIG. 3, a wheel 27 is seen either integrally formed with or attached to a pin 24. Pin 24 is adapted to be received within any one of holes 14, 15, 16, 17 or 18 by way of bushing 23. The wheel 27 has a track riding surface 26 to interengage with a track 29 as illustrated in FIG. 4. The pin 24 might be provided with any convenient means to prevent the same from being inadvertently withdrawn from its hole. For example, a hole 25 might be provided to take a split pin.

FIG. 3(*a*), an alternatively pin/wheel assembly is depicted. In this instance the pin 24 is provided with an expanding tapered end 400 to pass through bush 23 in this embodiment, a hole 25 to receive a locking pin is not necessary.

With reference to FIG. 4, the wheel 27 upon pin 24 is shown mounted upon a track 29. Track 29 might be formed from extruded aluminium or pressed steel or any other portion 29' of track 29. This lip portion 29' is provided with a number of small indents 40 which serve as positioning lugs into which the track riding surface 26 clicks into engagement to indicate proper positioning of the louvres. In order to lock the transverse position of the louvres upon the track 29, a locking bar 28 is provided. The locking bar 28 comprises a locking lug 41 corresponding to each positioning lug 40. The locking bar 28 is adapted to be moved by any convenient means upwardly and downwardly to lock the wheel 27 against rolling or allow it to be freely moved along track 29. A pin 31 in slot 30 arrangement upon locking bar 28 is a typical means of providing proper alignment of the locking bar 29 with track 29.

Figure 8:
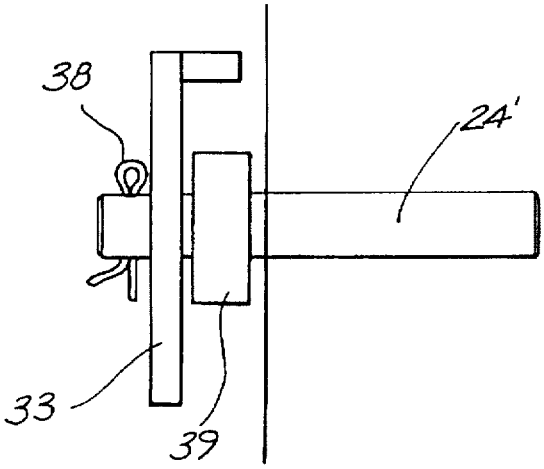
FIG. 8 is a schematic cross-sectional view of the connection of the control bar with a louvre.

In order to effect pivoting of each louvre 10, any one of the holes 14, 15, 16, 17 or 18 that is not being used to mount pin 24 may be utilised to effect pivoting. To this end, and with reference to FIG. 8, a pin 24' may be received in one of the holes. The pin 24' is to be connected with like pins located in all other louvres by a control bar utilised to effect pivoting. To this end, and with reference to FIG. 8, a pin 24' may be received in one of the holes. The pin 24' is to be connected with like pins located in all other louvres by a control bar 33. Control bar 33 is attached to each pin 24' and spaced from respective louvres by a bush 39. A split pin or the like 38 might be adopted to securely assemble the components of FIG. 8.

Figure 5:
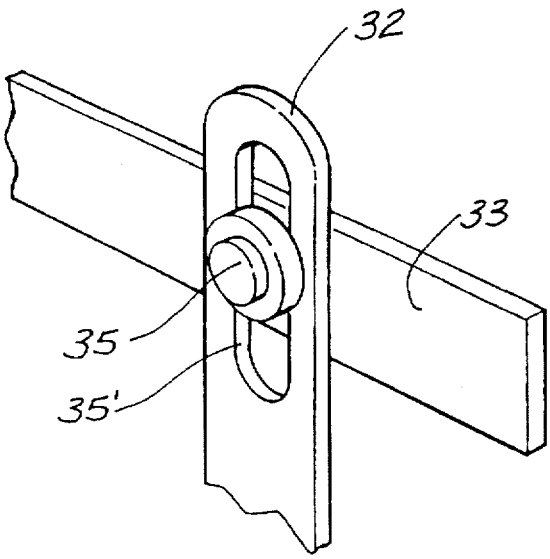
FIG. 5 is a schematic perspective view of a control bar and a driving bar.
Figure 6:
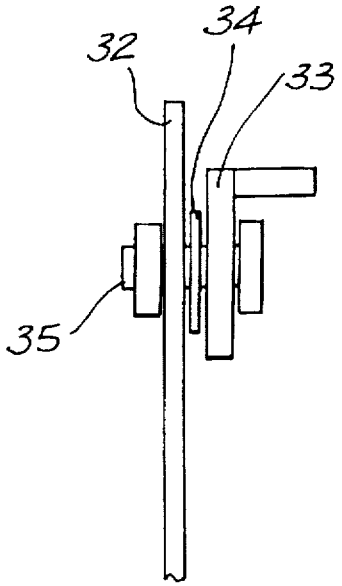
FIG. 6 is a schematic elevational view of the control bar and driving bar assembly of FIG. 5.

With reference now to FIG. 5, the control bar 33 is shown connected by pin 35 to a driving bar 32. Driving bar 32 is provided with a slot 35' within which the pin 35 affixed to control bar 33 may slide. Driving bar 32 might be connected to any drive means such as for example an electric motor or manual lever or the like. That is, when driving bar 32 is caused to pivot in a vertical plane, the control bar 33 will move in a direction essentially parallel to the track 29 thus effecting pivotal movement of louvres 10. FIG. 6 shows in more detail the assembly of control bar 33 and driving bar 32.

Figure 7:
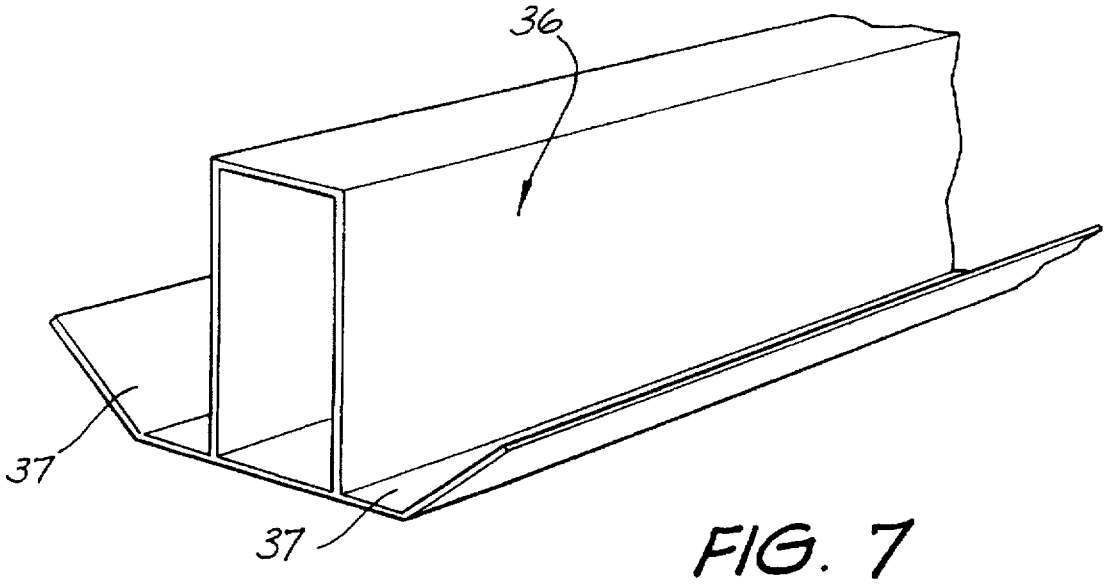
FIG. 7 is a schematic perspective view of a beam having gutters extending transversely from each side thereof, the beam being adapted to receive the assembly of FIG. 4.

With reference now to FIG. 7, a beam 36 is depicted. Although the track 29 might be mounted upon any vertical surface such as an existing beam on a pergola or terrace, a particularly suitable beam 36 is shown. Beam 36 comprises at least one gutter 37 and preferably two gutters 37. The track 29 and locking bar 28 might be affixed to the laterally opposed faces of the beam 36 such that any water falling from the louvres would be caught by the respective gutter 37 and then flow either to an existing downpipe or a purpose built downpipe.

In use, the louvres 10 may be fully or partially opened or even pivoted throughout an angle approaching 180. Where certain prior art louvres were adapted to pivot throughout an angle up to about 90, the louvres were vulnerable to incorrect orientation and could not take advantage of a northerly aspect (southern hemisphere) or southerly aspect (northern hemisphere) if incorrectly installed with a reverse orientation.

The present invention on the other hand is not susceptible to inadvertent reverse orientation by an installer. Furthermore, a particular advantage of sealing against wind and rain or the like is to be attained by the provision of lips 20 and 21 and a sealing strip mounted within groove 19.

Furthermore, in the winter months, the louvres may be transferred all to one end of the tracks or some to either ends of the tracks thus providing complete sun exposure to the area there below.

Referring now to FIGS. 10 to 14, it should be appreciated that the holes 14 to 18 need not be formed directly in the louvres themselves.

Rather, a separate end assembly 100 might be provided with its own holes or pins 101. Such an end assembly would be affixed to individual blades by their interengagement within a groove 102. A receiver channel 104 is provided with a number of holes 103 to receive pins 101. Alternatively, bushes 105 might be received within holes 103 and these bushes in turn would receive the pins 101. A hole 106 is provided in the receiver channel 104 to allow the fixing of a split pin 108 or the like to pin 101. The channel 104 is to be screwed or otherwise attached at 107 to a frame or gutter etc. The end assemblies may also be adapted for attachment to a single skin pressed aluminum or steel or plastic louvre or a double skin louvre.

Figure 15:
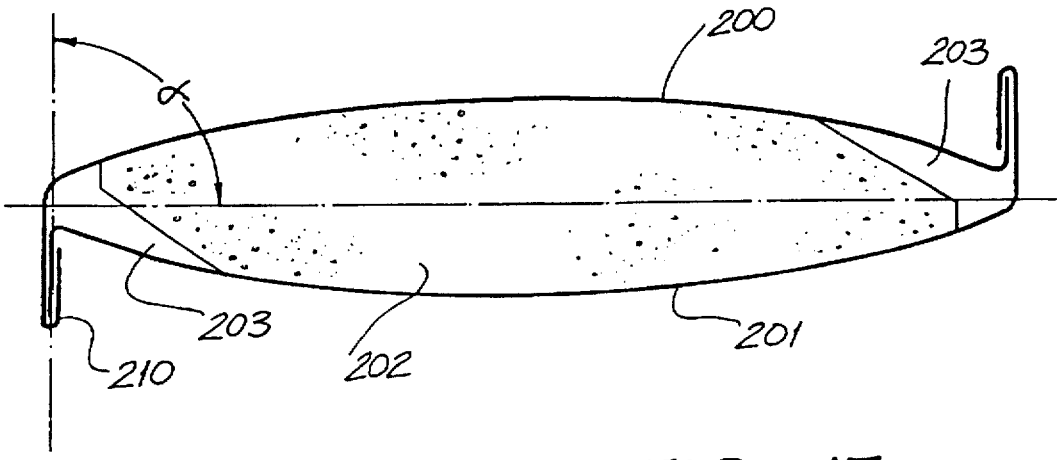
FIG. 15 is a schematic cross-sectional end elevational view of an alternative louvre.

As illustrated in FIG. 15, an alternative louvre is depicted. The louvre depicted comprises a pair of self tensioning surface profile sections 200 and 201. The sections may be roll formed steel, extruded steel, aluminium, plastics material, fibre glass or any suitably resilient, hard wearing, weather resistant material. Between the surface profile sections 200 or 201 there is located a foam core or blank 202. The foam core 202 might be preformed in the shape depicted. At laterally resilient, hard wearing, weather resistant material. At laterally opposing ends of the foam core, there is provided a tapering thus resulting in a gap 203 between the edge sections of the upper and lower surface profile sections 200 and 201.

Figure 17:
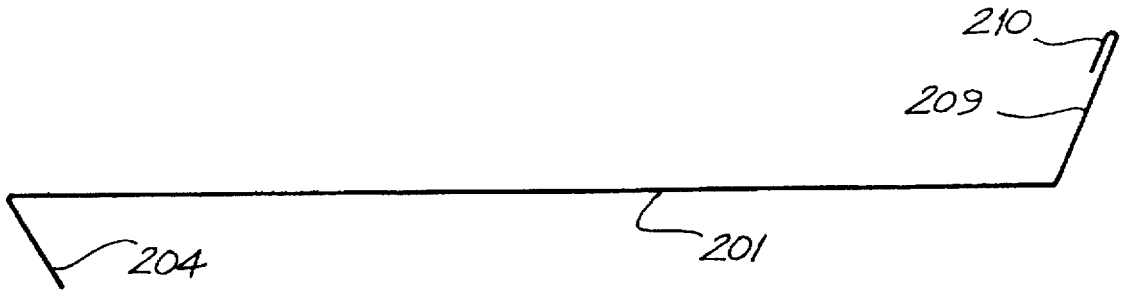
FIG. 17 is a schematic end elevational view of a single surface profile section, two of which are used in constructing the louvres of FIGS. 15 and 16.

With reference to FIG. 17, the surface profile section 201 might initially be relatively flat. Section 201 comprises at the left hand end a tongue 204 angled from the flat portion 201 more acutely than in the assembled configuration depicted in FIG. 15. In this assembled configuration, the angle alpha might typically be 90 plus or minus 5

Referring again to FIG. 17, at the right hand end, there is provided an extension 209 having a back-turned lip 210. It should be appreciated that such profile sections are capable of high stacking density and reduced transportation costs.

To assemble the louvre of FIG. 15, blank 202 might be placed upon section 201, and then section 200 placed upon the blank. At the left hand end, the lip 210 of the upper section 200 might first be engaged around the extension 204 of the lower section 201. Now at the right hand portion of upper section 200, downward pressure might be applied so as to bend that portion into the gap 203 to allow for engagement of tongue 204 beneath lip 210. Thus, in the assembled configuration, both upper and lower surface profile sections are resiliently biased.

Glue 205 might be placed between the respective tongues 204 and extensions 209 to further increase the assemble strength of the louvre and prevent the ingress of water to the louvre.

The foam material from which the blank is fabricated might be polystyrene, polyurethane or any other suitable material.

It may be that a special jig will be necessary in order to manually interengage the two surface profile section 200 and 201.

It is envisaged that in the clipped together configuration, the foam core provides good insulating properties.

Figure 16:
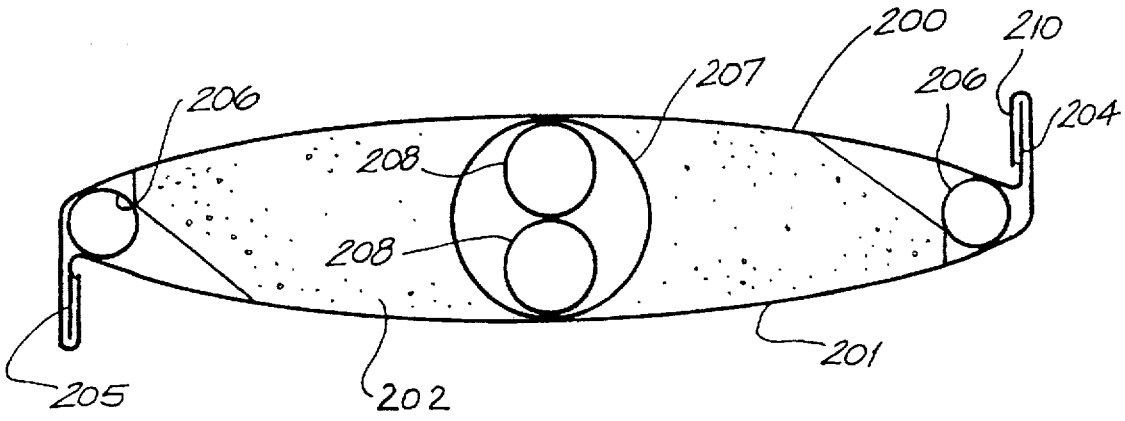
FIG. 16 is a schematic cross-sectional end elevational view of yet a further louvre.

In FIG. 16, an alternative and/or addition to the components of the louvre of FIG. 15 is depicted. Such additions include a pair of end tubes 206 formed in mild steel, aluminium, plastics, stainless steel or the like. Such tubes might run the entire length of the louvre or just a short length from longitudinally opposing ends. These tubes might serve to increase strength and/or as pivot points for the louvre in a louvre assembly. At the centre of the louvre profile, there might be provided a large pipe 207 having a pair of inner pipes 208 therein. Such might act as a beam in a louvre of high length, whilst also providing two pivot points 208 for the louvre in an assembly. Separate foam cores might be located at either side of the large pipe 207 to add insulation and/or rigidity properties to the louvre. As an alternative, expandable foam might be injected into the space between the upper and lower profiles 200 and 201. Although these tubular sections are shown as circular, they might likewise be elliptical, square or rectangular.

Figure 18:
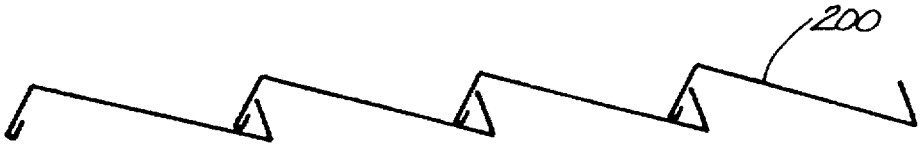
FIG. 18 is a schematic end elevational view of a series of surface profile sections in edge to edge engagement.
Figure 19:
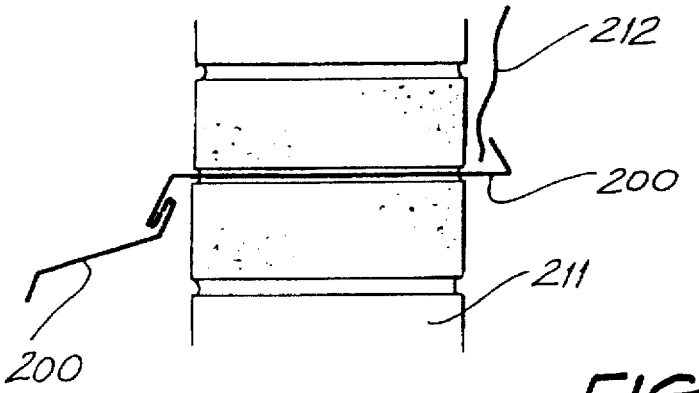
FIG. 19 is a schematic illustration of a brick wall having extending there through a surface profile section acting as a damp course or as a means by which an awning may be affixed to the wall.

In FIG. 18, a series of profile sections 200 are depicted overlapping to form roof sheeting. Should the series of interengaged louvres be inverted, the water carrying capacity of the roof might be improved. In FIG. 19 a section 200 is used as a flashing between a course of bricks 211. An addition louvre 200 might be affixed as depicted to provide an awning. Such might allow a plastic membrane or insulation 212 to be held in position to trap condensation and transfer same to the outside of the wall.

Reverting now to FIGS. 15 and 16, it should be understood that a particular advantage of the assembly is that where damage occurs to one side of the same, it might be readily removed and replaced. A further advantage is a simple, yet cost effective way to alter colours of existing structures by replacing either the underside or topside sections.

I claim:

1. A louvre for a louvre assembly, comprising:

a pair of ends and a pair of laterally opposed edges extending from one of said ends to the other of said ends, each of said ends having a thickness and one of said ends having a plurality of substantially round pivot mounting holes formed in said thickness for accommodating respective cylindrical pins, one of said pivot mounting holes being situated centrally of the end and the remaining holes respectively located on opposite sides and at respective distances therefrom, wherein any one of said holes is utilized for mounting the louvre in the assembly, and any one of the remaining holes is utilized for controlling the pivotable orientation of the louvre about a longitudinal axis of the louvre coinciding with the pivot mounting hole, and an up-turned lip at one of said edges of the louvre and a down-turned lip at the other of said edges of the louvre.

2. The louvre as claimed in claim 1, further comprising a groove located near one of said lips for receiving a sealing strip to seal against a sealing surface upon a like formed adjacent louvre in the assembly when in a closed orientation.

3. The louvre as claimed in claim 1, comprising upper and lower surfaces, said upper surface being spaced from said lower surface by internal ribs.

4. The louvre as claimed in claim 3, wherein an insulating foam is injected into the space between the upper and lower surfaces of the louvre.

5. A louvre assembly comprising a plurality of louvres, each louvre having a pair of ends and a pair of laterally opposed edges extending from one of said ends to the other of said ends, one of said ends including a plurality of optionally useable pivot mounting holes, one of which is situated centrally of the end, one of the pivot mounting holes being used to mount the louvre in the assembly and another of which is controlled to effect the pivotal orientation of the louvre so as to allow light to pass through the assembly, each louvre further comprising an up-turned lip at one edge of the louvre and a down-turned lip at the other edge of the louvre, wherein at each end of each louvre there is provided a wheel mounted to rotate at a selected one of said pivot mounting holes, the assembly further comprising a transverse track at each end of the respective louvres upon which said respective wheels roll, and a locking bar moveable into a first position wherein the wheels are locked thereby against rolling upon the track, and a second position wherein the wheels are free to roll.

6. The louvre assembly as claimed in claim 5, wherein each of said wheels includes a pin with a tapered end to pass through a bush and capable of being received within one of said pivot mounting positions.

7. The louvre assembly as claimed in claim 5, wherein the tracks each comprise positioning lugs into which the wheels roll, the positioning lugs being respectively aligned with locking lugs provided in the locking bar.

8. The assembly as claimed in claim 5, further comprising a pin at said another mounting position being controlled by a transversely extending control bar, the control bar in turn being controlled by a driving bar.

9. The louvre assembly of claim 8, wherein the driving bar extends in an essentially vertical orientation and comprises a pin-in-slot interengagement with the control bar.

10. The louvre assembly as claimed in claim 5, wherein each of said plurality of louvres are mounted between a pair of beams extending transversely with respect to the longitudinal axis of the louvres, each beam including at least one gutter upon which water may fall from respective ends of the louvres.

11. A louvre comprising a pair of elongate, surface sections, each having disposed at opposed lateral edges thereof means for mutual interengagement of the sections upon flexure of the respective sections during assembly, said surface sections being sufficiently resilient so as to enable said flexure, wherein said means for mutual interengagement comprise at one edge of each respective section a tongue, and at the other edge an extension having a back-turned lip into which the tongue of the other section is receivable; and the louvre further comprising a prefabricated core having opposed lateral edges, said core being tapered at said lateral edges, and each of said edges of said core and said respective lateral edges of said surface sections defining a gap between each opposed edge of the core and the respective lateral edge of the resilient surface section, said gap being dimensioned such that a larger portion of said gap at one lateral edge of said louvre is above a central longitudinal plane extending through said louvre and a larger portion of said gap at the other lateral edge of said louvre while a smaller portion of said gap is below said longitudinal plane is below said central longitudinal plane while a smaller portion of said gap is above said longitudinal plane so as to allow said mutual means for interengagement of the resilient surface sections to enter said gap when said respective sections are pressed together for assembly or disassembly whereby said interengagement means of said resilient sections and said gaps cooperate to effect said assembly and disassembly.

12. The louvre as claimed in claim 11, further comprising a number of tubes inserted between the surface sections, the tubes serving as a means by which the louvre can be pivoted in a louvre assembly.

13. A louvre according to claim 1, wherein said remaining pivot mounting holes are located adjacent respective terminal sides of said end.

14. A louvre according to claim 13, in which said remaining pivot mounting holes have an overlapping circle configuration.

15. The combination of the louvre of claim 1 and said respective pins.

* * * * *

UNITED STATES PATENT AND TRADEMARK OFFICE

CERTIFICATE OF CORRECTION

PATENT NO. : 5,732,507
DATED : March 31, 1998
INVENTOR(S) : Gregory Edwards

It is certified that error appears in the above-indentified patent and that said Letters Patent is hereby corrected as shown below:

Column 8, line 34 (Claim 11, line 18) after "louvre" insert--while a smaller portion of said gap is below said longitudinal plane--.

Column 8, lines 36-37, delete "while a smaller portion of said gap is below said longitudinal plane".

Signed and Sealed this

First Day of December, 1998

*Attest:*

*Attesting Officer*

Bruce Lehman

BRUCE LEHMAN

*Commissioner of Patents and Trademarks*